US010544009B2

(12) United States Patent
Hu

(10) Patent No.: US 10,544,009 B2
(45) Date of Patent: Jan. 28, 2020

(54) ELEVATOR SERVICE PANEL

(71) Applicant: Otis Elevator Company, Farmington, CT (US)

(72) Inventor: Guohong Hu, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 293 days.

(21) Appl. No.: 15/437,560

(22) Filed: Feb. 21, 2017

(65) Prior Publication Data

US 2017/0240384 A1 Aug. 24, 2017

Related U.S. Application Data

(60) Provisional application No. 62/298,735, filed on Feb. 23, 2016.

(51) Int. Cl.
*B66B 11/02* (2006.01)
*B66B 5/18* (2006.01)

(52) U.S. Cl.
CPC ..... *B66B 11/0246* (2013.01); *B66B 11/0206* (2013.01); *B66B 5/18* (2013.01)

(58) Field of Classification Search
CPC .... B66B 11/0246; B66B 11/0206; B66B 5/18
See application file for complete search history.

(56) References Cited

U.S. PATENT DOCUMENTS 2,897,920 A * 8/1959 Falter ..... B66B 5/22 187/372
5,033,587 A * 7/1991 Nakai ..... B66B 5/18 187/288
6,029,778 A * 2/2000 Lacarte Estallo ..... B66B 1/465 187/414
6,302,240 B1 * 10/2001 Shih ..... B66B 1/461 187/397
7,523,809 B2 * 4/2009 Monzon-Simon .... B66B 5/0056 182/148
8,316,998 B2 11/2012 Henseler
2003/0015378 A1 * 1/2003 Elsener ..... B66B 5/0087 187/336

(Continued)

FOREIGN PATENT DOCUMENTS

CN 201729581 U 2/2011
CN 204823594 U 12/2015

(Continued)

OTHER PUBLICATIONS

JP2009196784—Machine Translation (Year: 2009).*

(Continued)

*Primary Examiner* — Michael A Riegelman
(74) *Attorney, Agent, or Firm* — Cantor Colburn LLP

(57) ABSTRACT

An elevator system including an elevator car frame including an interior side, a service panel operably coupled to the interior side of the elevator car frame, the service panel including a panel interior side and a panel exterior side, and configured to operate between an open and closed position, an elevator car operably coupled to the elevator car frame, the elevator car including an interior cavity, wherein the panel exterior side is disposed within the interior cavity when the service panel is in an open position.

4 Claims, 5 Drawing Sheets

(56) References Cited

U.S. PATENT DOCUMENTS

| | | | | |
|---|---|---|---|---|
| 2005/0224299 | A1* | 10/2005 | Soemardjan | B66B 11/0246 187/406 |
| 2008/0078627 | A1* | 4/2008 | Wang | B66B 5/027 187/314 |
| 2010/0038183 | A1* | 2/2010 | Henseler | B66B 11/0246 187/276 |
| 2012/0255815 | A1* | 10/2012 | Koskelainen | B66B 5/027 187/401 |
| 2015/0246792 | A1* | 9/2015 | Baltis | B66B 11/0246 187/276 |
| 2017/0001835 | A1* | 1/2017 | Hu | B66B 5/18 |
| 2017/0066627 | A1* | 3/2017 | Hu | B66B 5/18 |
| 2017/0144862 | A1* | 5/2017 | Fernandez | B66B 11/0246 |
| 2017/0144863 | A1* | 5/2017 | Minami | B66B 11/0226 |
| 2017/0240384 | A1* | 8/2017 | Hu | B66B 11/0206 |
| 2017/0297870 | A1* | 10/2017 | Fauconnet | B66B 11/0226 |
| 2018/0037440 | A1* | 2/2018 | Blondel | B66B 11/0233 |
| 2018/0105395 | A1* | 4/2018 | Cortes | B66B 5/0087 |
| 2018/0111796 | A1* | 4/2018 | Peigne | B66B 1/14 |
| 2018/0111797 | A1* | 4/2018 | Fauconnet | B66B 11/0253 |
| 2018/0118519 | A1* | 5/2018 | Fonteneau | B66B 5/0087 |
| 2018/0208437 | A1* | 7/2018 | Durand | B66B 11/0233 |
| 2018/0222723 | A1* | 8/2018 | Gressien | B66B 5/0087 |
| 2018/0339879 | A1* | 11/2018 | Quaretti | B66B 3/008 |

FOREIGN PATENT DOCUMENTS

| | | | |
|---|---|---|---|
| EP | 0968954 | B1 | 5/2003 |
| EP | 1031528 | B1 | 6/2003 |
| JP | 2009196784 | A | 9/2009 |
| WO | 200179104 | A1 | 10/2001 |
| WO | 0189977 | A1 | 11/2001 |
| WO | 2013190616 | A1 | 12/2013 |
| WO | 2015152918 | A1 | 10/2015 |

OTHER PUBLICATIONS

European Patent Office, European Search Report for Application No. 17157016.1, dated Aug. 4, 2017.

Chinese First Office Action for application CN 201710093418.4, dated Nov. 1, 2019, 12 pages.

* cited by examiner

ELEVATOR SERVICE PANEL

CROSS-REFERENCE TO RELATED APPLICATION

The present application is a nonprovisional patent application, which claims priority to U.S. Patent Application Ser. No. 62/298,735, filed Feb. 23, 2016, which is herein incorporated in its entirety.

TECHNICAL FIELD OF THE DISCLOSED EMBODIMENTS

The present disclosure generally relates to elevator cars, and more particularly, the present disclosure relates to an elevator service panel.

BACKGROUND OF THE DISCLOSED EMBODIMENTS

Generally, some components for operating an elevator system are disposed within the hoistway. To install or service these components, an elevator mechanic may have to enter the hoistway from the pit area or from the top of the car. Doing so may create a risk of injury to the elevator mechanic due to unexpected movement of the elevator car and/or a potential fall hazard. Accordingly, there exists a need for an improved way to install and service elevator components located in the hoistway.

SUMMARY OF THE DISCLOSED EMBODIMENTS

In one aspect, an elevator system is provided. The elevator system includes an elevator car frame including an interior side, a service panel operably coupled to the interior side of the elevator car frame, the service panel comprising a panel interior side and a panel exterior side, and configured to operate between an open and closed position, an elevator car operably coupled to the elevator car frame, the elevator car comprising an interior cavity, wherein the panel exterior side is disposed within the interior cavity when the service panel is in an open position.

In an embodiment, the elevator car frame further includes at least one frame mounting aperture, and the service panel comprises at least one panel aperture. In the preceding embodiment, each of the at least one panel apertures are substantially aligned with each of the at least one frame mounting aperture.

In an embodiment, the elevator car frame further includes a frame attachment means disposed on the interior side, and the service panel further comprises a panel attachment means. In an embodiment, the frame attachment means comprises a frame mounting tab and the panel attachment means comprises a panel mounting tab. In an embodiment, the frame mounting tab comprises a frame mounting tab aperture disposed therein, and the panel mounting tab comprises a panel mounting tab aperture disposed therein. In an embodiment, the frame mounting tab aperture and the panel mounting tab aperture are substantially aligned. In an embodiment, the elevator system further includes a mounting device disposed within the frame mounting tab aperture and the panel mounting tab aperture.

In an embodiment, the elevator system further includes an elevator component operably coupled to the panel exterior side.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
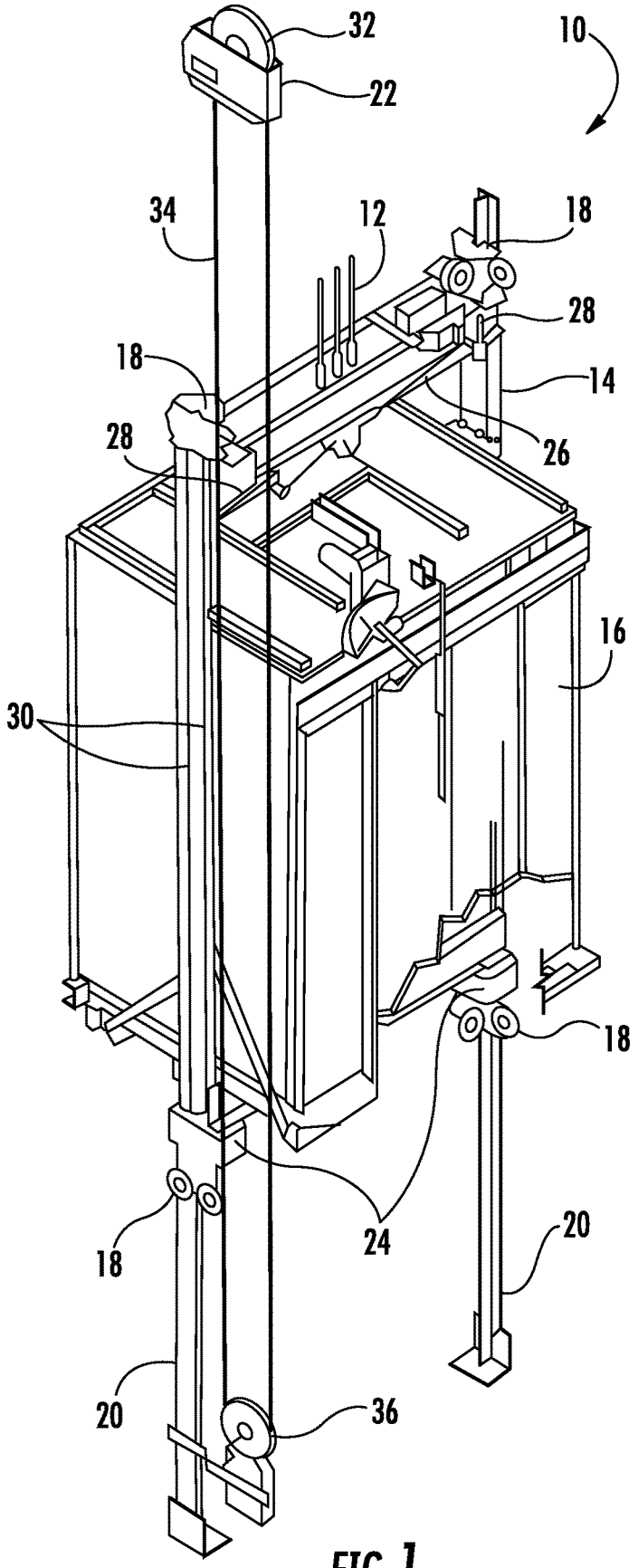
FIG. 1 is a schematic diagram of an elevator system according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 shows an elevator system, generally indicated at 10. The elevator system 10 includes cables 12, a car frame 14, a car 16, roller guides 18, guide rails 20, a governor 22, safeties 24, linkages 26, levers 28, and lift rods 30. Governor 22 includes a governor sheave 32, rope loop 34, and a tensioning sheave 36. Cables 12 are connected to car frame 14 and a counterweight (not shown in FIG. 1) inside a hoistway. Car 16, which is attached to car frame 14, moves up and down the hoistway by force transmitted through cables 12 to car frame 14 by an elevator drive (not shown) commonly located in a machine room at the top of the hoistway. Roller guides 18 are attached to car frame 14 to guide the car 16 up and down the hoistway along guide rail 20. Governor sheave 32 is mounted at an upper end of the hoistway. Rope loop 34 is wrapped partially around governor sheave 32 and partially around tensioning sheave 36 (located in this embodiment at a bottom end of the hoistway). Rope loop 34 is also connected to elevator car 16 at lever 28, ensuring that the angular velocity of governor sheave 32 is directly related to the speed of elevator car 16

In the elevator system 10 shown in FIG. 1, governor 22, an electromechanical brake (not shown) located in the machine room, and safeties 24 act to stop elevator car 16 if car 16 exceeds a set speed as it travels inside the hoistway. If car 16 reaches an over-speed condition, governor 22 is triggered initially to engage a switch, which in turn cuts power to the elevator drive and drops the brake to arrest movement of the drive sheave and thereby arrest movement of car 16. If, however, cables 12 break or car 16 otherwise experiences a free-fall condition unaffected by the brake, governor 22 may then act to trigger safeties 24 to arrest movement of car 16. In addition to engaging a switch to drop the brake, governor 22 also releases a clutching device that grips the governor rope 34. Governor rope 34 is connected to safeties 24 through mechanical linkages 26, levers 28, and lift rods 30. As car 16 continues its descent unaffected by the brake, governor rope 34, which is now prevented from moving by actuated governor 22, pulls on operating lever 28. Operating lever 28 "sets" safeties 24 by moving linkages 26 connected to lift rods 30, which lift rods 30 cause safeties 24 to engage guide rails 20 to bring car 16 to a stop.

Figure 3:
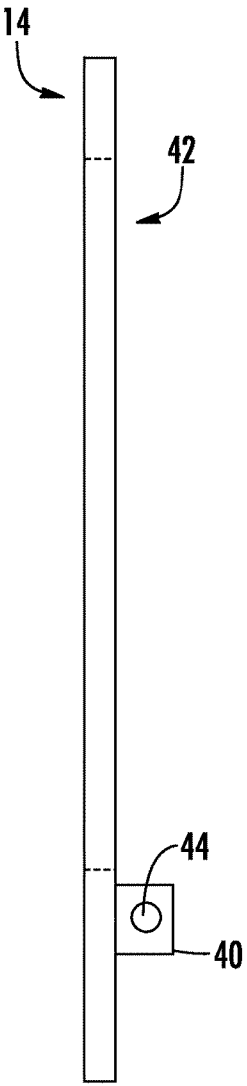
FIG. 3 is a schematic perspective view of an elevator car frame according to an embodiment of the present disclosure.
Figure 2:
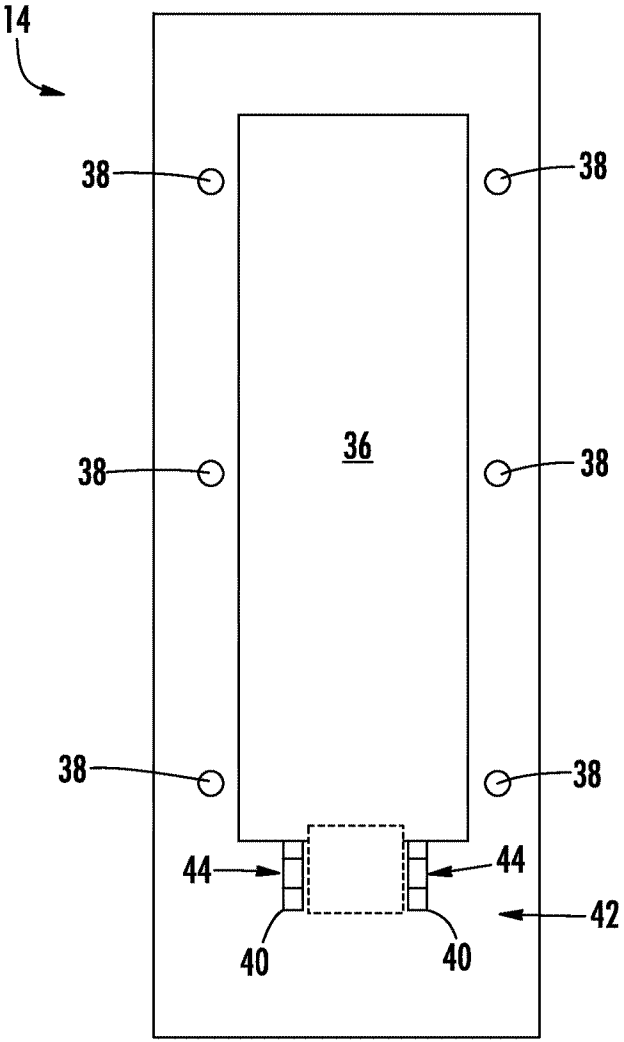
FIG. 2 is a schematic front view of an elevator car frame according to an embodiment of the present disclosure.

FIGS. 2-3 show a portion of the car frame 14. A portion of the car frame 14 includes a frame aperture 36 disposed therein. The frame aperture 36 is configured to provide a means for installation and maintenance of elevator components, such as the safety actuation device 23 and safety 24 to name a couple of non-limiting examples, that operate external to the car frame 14. The portion of the car frame 14 further includes at least one frame mounting aperture 38 located circumferentially around the frame aperture. 36. The at least one frame mounting aperture 38 is configured to receive a fastening device (not shown), such as a bolt or screw to name a couple of non-limiting examples.

The portion of the car frame 14 further includes a frame attachment means 40 located on an interior portion 42 of the car frame 14. In the embodiment shown, the frame attachment means 40 is located below the frame aperture 36; however, it will be appreciated that the frame attachment means 40 may be located on any interior side of the frame aperture 36. In an embodiment, the frame attachment means 40 includes a frame attachment tab including a frame attachment aperture 44 disposed therein, the frame attachment aperture 44 is configured to receive and hold a mounting device 46 (shown in FIG. 4). In another embodiment, as shown in FIG. 5, the frame attachment means 40 includes a slot located below the frame aperture 36. It will be appreciated that the frame attachment means 40 may be configured in any shape and include any means for attaching and holding the service panel 48 (shown in FIG. 4).

Figure 4:
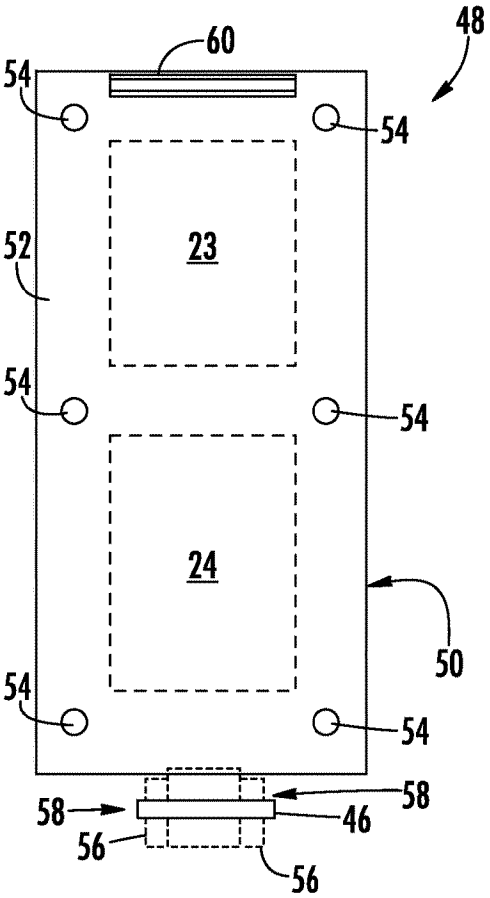
FIG. 4 is a schematic front view of an car frame service panel according to an embodiment of the present disclosure.
Figure 6:
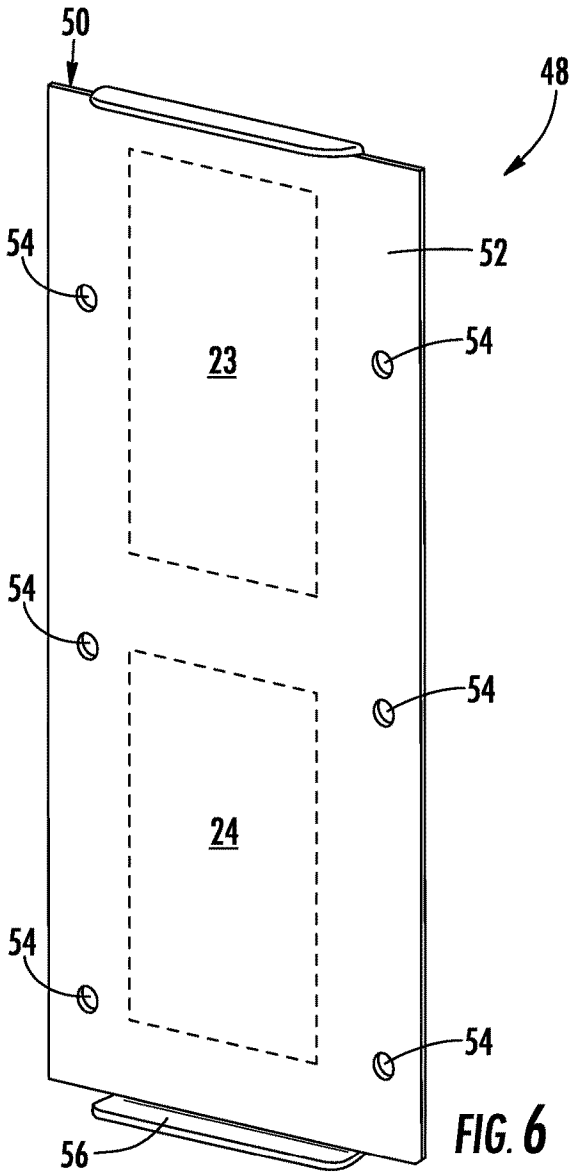
FIG. 6 is a schematic perspective view of an car frame service panel according to an embodiment of the present disclosure.
Figure 5:
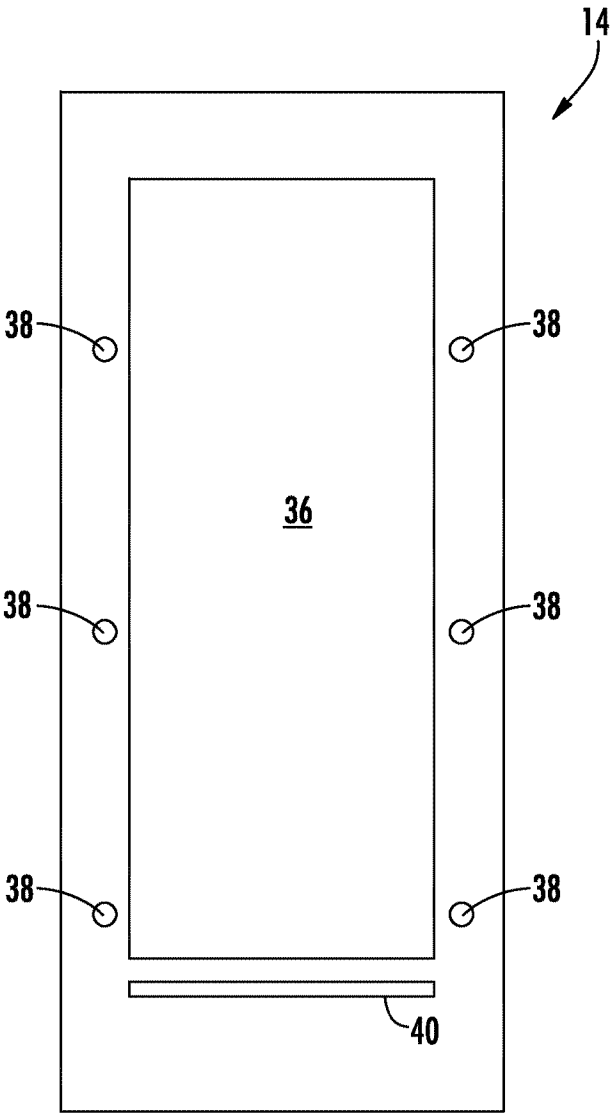
FIG. 5 is a schematic front view of an elevator car frame according to an embodiment of the present disclosure.

FIGS. 4 and 6 shows embodiments of a service panel 48, including an interior side 50 and an exterior side 52. The service panel 48 is configured to hold the elevator component on the exterior side 52 of the service panel 48. It will be appreciated that elevator component may be affixed to the exterior side 52 of the service panel 48 by any known fastening device, such as bolts and screws to name a couple of non-limiting examples.

The service panel 48 further includes at least one panel aperture 54 disposed circumferentially around the perimeter of the service panel 48. Each of the at least one panel apertures 54 is configured to substantially align with each of the at least one frame mounting apertures 38 to facilitate the attachment of the service panel 48 to the interior portion 42 of the car frame 14 via a fastening device (not shown).

In an embodiment, the service panel 48 further includes a panel attachment means 56. In the embodiment shown, the panel attachment means 56 is disposed on the exterior side 52 of the service panel 48 and located at the bottom of the service panel 48; however, it will be appreciated that the panel attachment means 56 may be located in any location on the interior side 50 or exterior side 52 of the service panel 48 such that the panel attachment means 56 may be substantially aligned with frame attachment means 40.

In the embodiment shown in FIG. 4, the panel attachment means 56 includes a panel attachment tab including a panel attachment aperture 58 disposed therein, the panel tab aperture 58 is configured to substantially align with each of the frame tab apertures 44, such that the mounting device 46 may be disposed within the panel tab aperture 58 and frame attachment apertures 44; thus, allowing the service panel 48 to rotate within the interior of the car frame 14. It will be appreciated that the mounting device 46 may be a pin, rod, or bolt to name a few non-limiting examples. It will further be appreciated that the panel attachment means 56 and the frame attachment means 40 may be replaced by a hinge to perform the same function of allowing the service panel 48 to rotate within the interior of the car frame 14. In the embodiment shown in FIG. 6, the panel attachment means 56 includes a flange. The flange may be configured to be disposed within the slot 40 shown in FIG. 5.

In an embodiment, the service panel 48 further includes a flange 60 configured to engage a portion of the frame aperture 36 to give the service panel 48 a tight fit within the frame aperture 36 such that when the fastening devices are removed from the at least one frame mounting aperture 38 and at least one panel aperture 54, the service panel 48 does not fall into the interior of the car 16 potentially causing injury to a person within the car 16 and/or causing damage to the elevator components affixed to the service panel 48. In the embodiment shown, the flange 60 is located at the top of the service panel 48; however, the flange 60 may be disposed in any location along the perimeter of the service panel 48.

Figure 8:
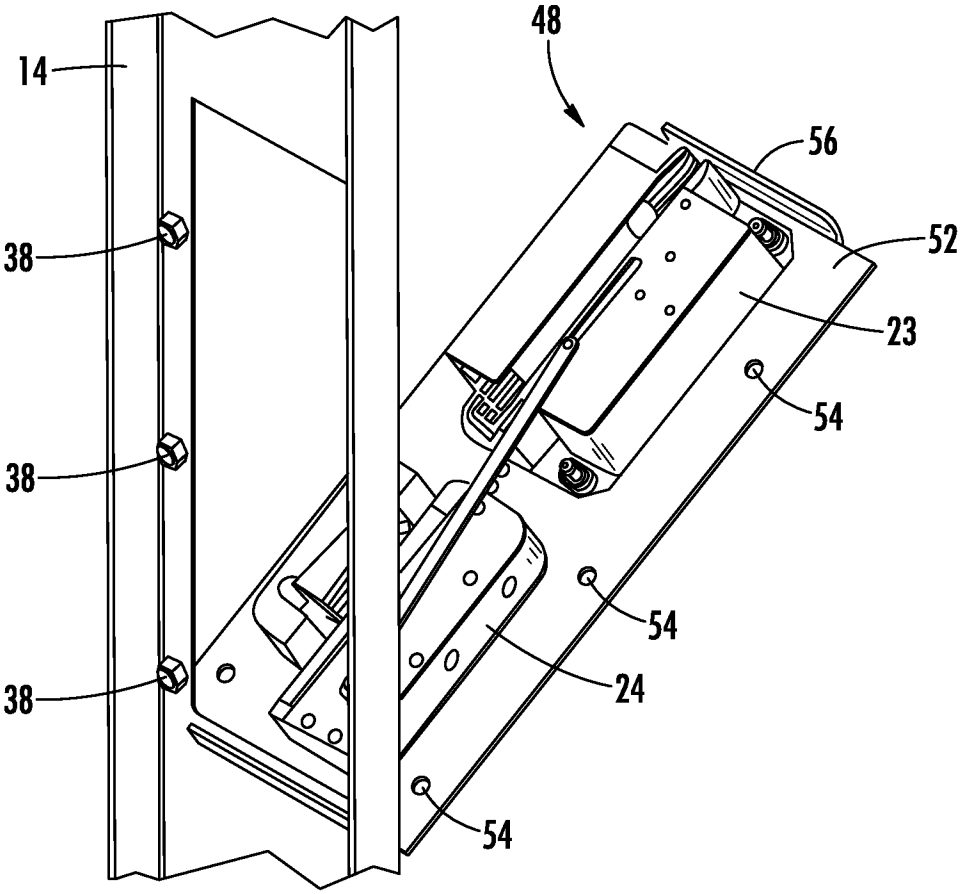
FIG. 8 is a schematic diagram of an elevator service panel in a partially open position.
Figure 7:
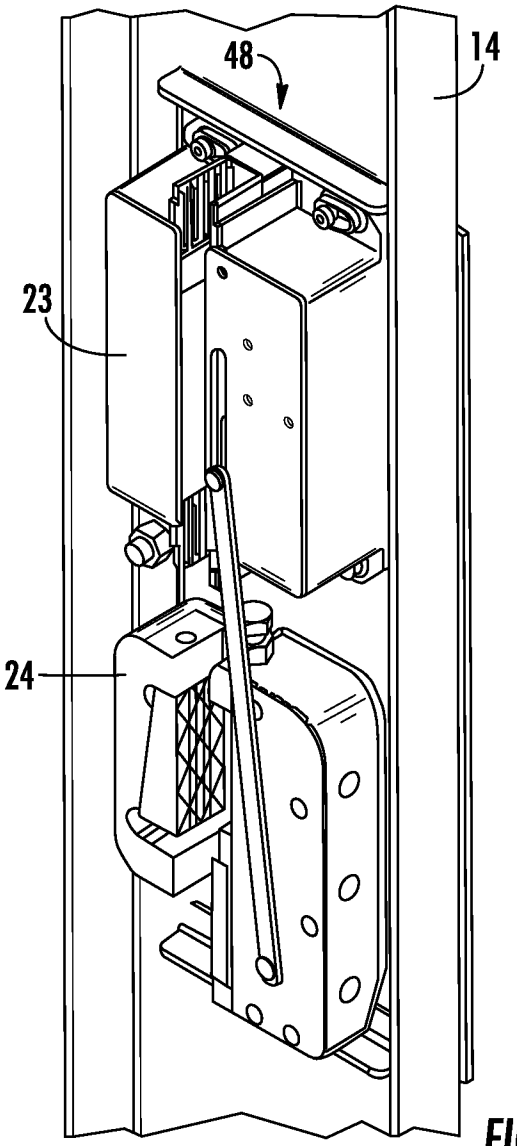
FIG. 7 is a schematic diagram of an elevator service panel in a closed position.
Figure 9:
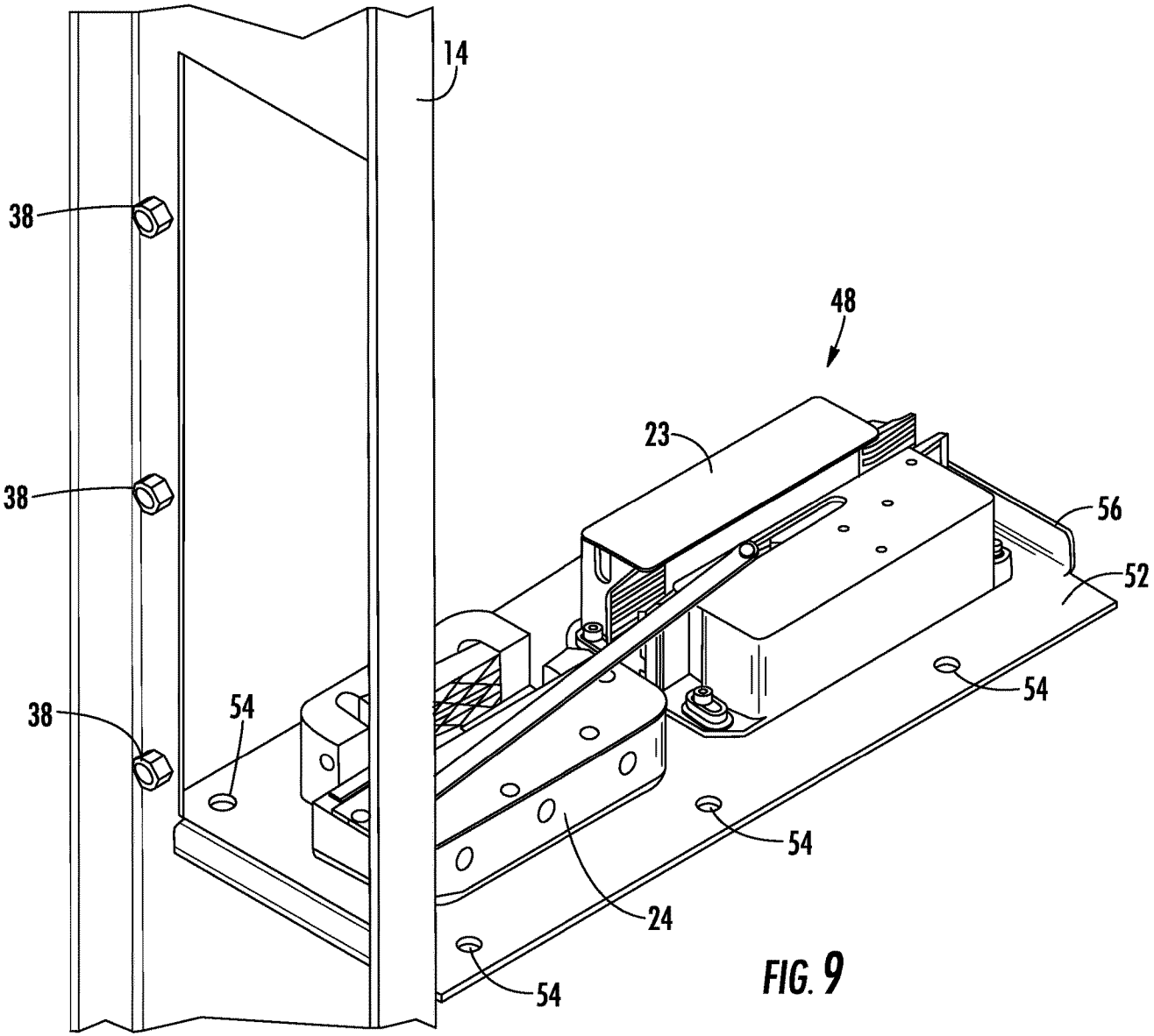
FIG. 9 is a schematic diagram of an elevator service panel in an open position.

FIGS. 7-9 show an embodiment of the service panel 48 in operation. FIG. 7 shows the service panel 48 in a closed position, such that the elevator component (e.g., elevator safety actuation device 23 and safety 24) may perform its customary functions within the elevator hoistway. In some embodiments, after the fastening devices are removed, the service panel remains in a closed position due to the flange 60. FIG. 8 shows the service panel in a partially open position. After the fastening devices are removed from the at least one mounting aperture 38 and at least one panel aperture 54, the service panel 48 may rotate inward within the elevator car 16, via the mounting device 46 to allow access to the elevator components. FIG. 9 shows the service panel 48 in a fully open position. In the fully open position, an elevator mechanic may service or replace the elevator components from inside of the elevator car 16.

It will therefore be appreciated that the present elevator system 10 includes an service panel 48 operably coupled to the elevator car frame 14, such that the service panel 48 may be rotated towards the interior of the elevator car 16 to allow an elevator mechanic to service the elevator component from inside of the car; thus, providing a safer environment for the elevator mechanic to perform his/her necessary functions, and reducing the likeliness of injury.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

an elevator car frame;

a service panel operably coupled to the elevator car frame, the service panel comprising a panel interior side and a panel exterior side, and configured to operate between an open and closed position;

an elevator car operably coupled to the elevator car frame, the elevator car comprising an interior cavity;

wherein the panel exterior side is disposed within the interior cavity when the service panel is in an open position;

wherein the elevator car frame further comprises a frame attachment means and the service panel further comprises a panel attachment means;

wherein the frame attachment means comprises a frame mounting tab and the panel attachment means comprises a panel mounting tab.

2. The elevator system of claim 1, wherein the frame mounting tab comprises a frame mounting tab aperture disposed therein, and the panel mounting tab comprises a panel mounting tab aperture disposed therein.

3. The elevator system of claim 2, wherein the frame mounting tab aperture and the panel mounting tab aperture are substantially aligned.

4. The elevator system of claim 3, further comprising a mounting device disposed within the frame mounting tab aperture and the panel mounting tab aperture.

* * * * *